United States Patent [19]

Brennan et al.

[11] Patent Number: 4,537,459

[45] Date of Patent: Aug. 27, 1985

[54] JACK FOR EMI/RFI SHIELD TERMINATING MODULAR PLUG CONNECTOR

[75] Inventors: Robert J. Brennan, Ossining; Terrence Meighen, Stormville; Walter M. Phillipson, Woodside, all of N.Y.

[73] Assignee: Stewart Stamping Corporation, Yonkers, N.Y.

[21] Appl. No.: 570,806

[22] Filed: Jan. 16, 1984

[51] Int. Cl.[3] ..... H01R 13/652

[52] U.S. Cl. ..... 339/143 R; 339/DIG. 3

[58] Field of Search ..... 339/143 R, 98, 99 R, 339/176 M, 176 MP, DIG. 3

[56] References Cited

U.S. PATENT DOCUMENTS

| | | | |
|---|---|---|---|
| 4,224,485 | 9/1980 | Krumreich | 339/176 M X |
| 4,239,316 | 12/1980 | Spaulding | 339/176 M X |
| 4,424,403 | 1/1984 | Bogese | 339/99 R X |
| 4,457,575 | 7/1984 | Davis et al. | 339/176 MP X |

*Primary Examiner*—Eugene F. Desmond

*Attorney, Agent, or Firm*—Steinberg & Raskin

[57] ABSTRACT

A jack for a modular plug connector which terminates an EMI/RFI shield surrounding the conductors of a cord, as well as the cord conductors themselves as is conventional, by which the electromagnetic and radio frequency signals radiated from the conductors and carried through the shield are grounded. The jack includes front and back parts connected to each other to define a rearwardly opening receptacle for a conventional multi-contact modular insert and a communicating forwardly opening receptacle for the modular plug connector. The jack is provided with a grounded contact which, upon insertion of the modular plug connector, electrically engages a shield terminating contact which forms a part of the modular plug connector to thereby electrically couple the grounded jack contact with the EMI/RFI shield surrounding the cord conductors. The front part and possibly the back part of the jack may be formed of a plastic material which provides good EMI/RFI shielding to control radiation of high frequency signals from within the jack as well as to suitably attenuate any high frequency signals radiated from equipment external to the jack passing into the connector receptacle.

21 Claims, 5 Drawing Figures

FIG. 2
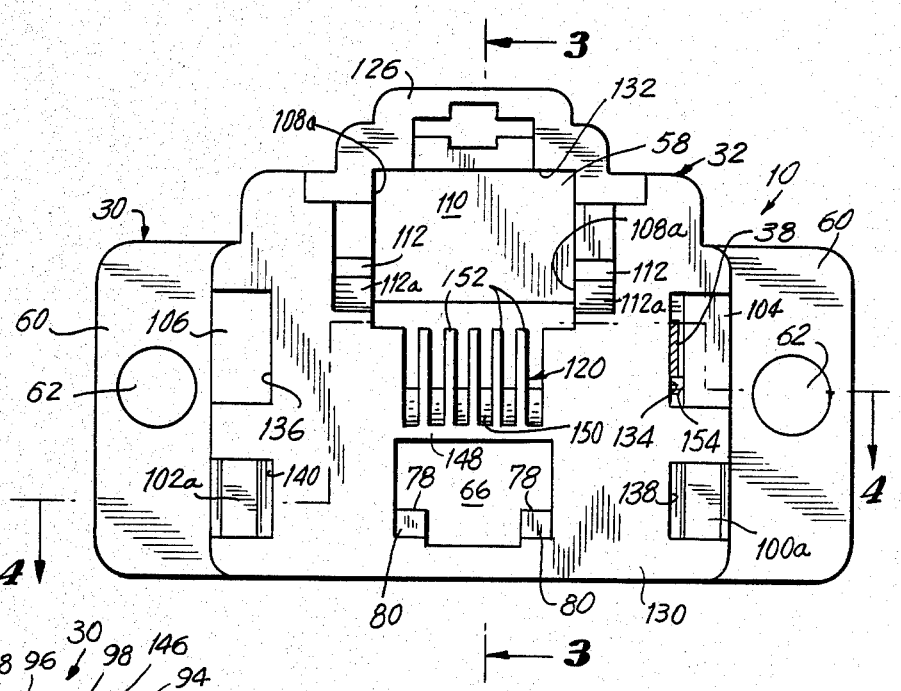
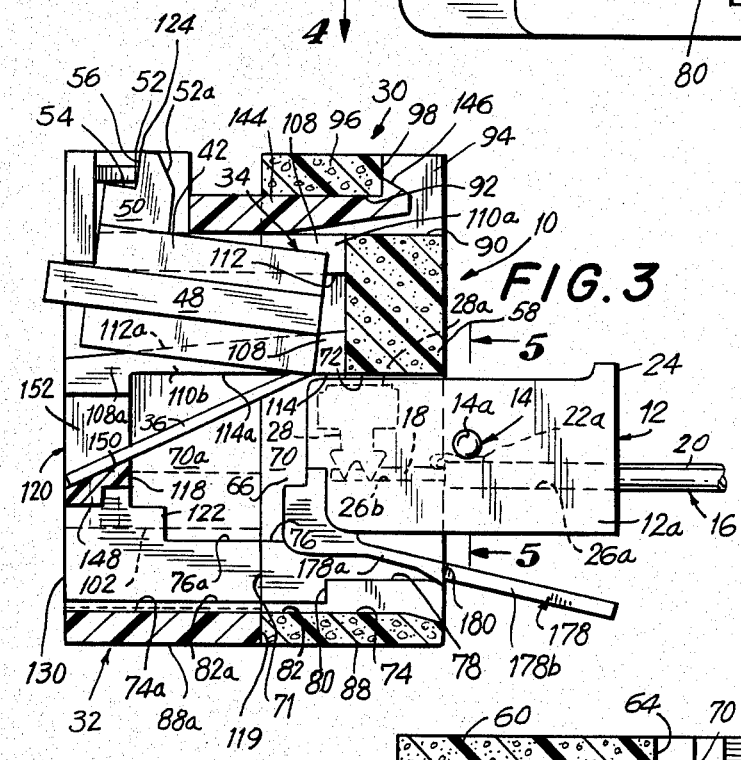
FIG. 3
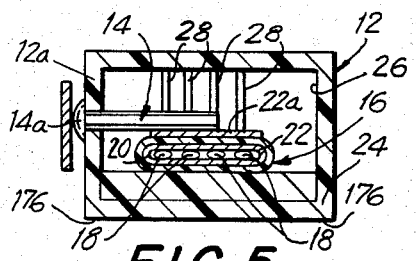
FIG. 5
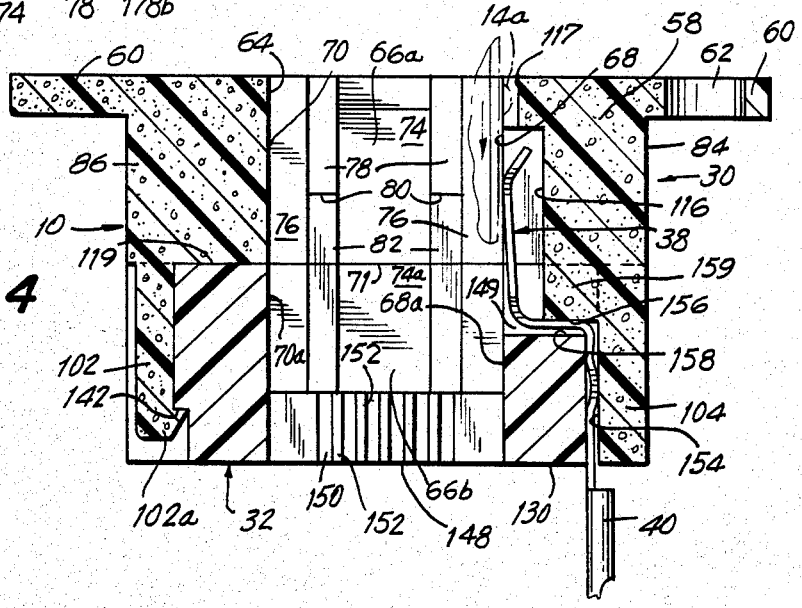
FIG. 4

JACK FOR EMI/RFI SHIELD TERMINATING MODULAR PLUG CONNECTOR

BACKGROUND OF THE INVENTION

This invention relates generally to electrical connector components and, more particularly, to jacks for modular plug connectors which terminate multi-conductor cordage. More specifically, this invention relates to such jacks which serve to conduct to ground interference-causing electromagnetic and radio frequency signals carried in a conductive shield surrounding the conductors of a cord and, if desired, for providing shielding to control any leakage of such radiation from within the jack as well as suitably attenuating externally generated high frequency signals passing into the jack.

It has been recognized that digital-based electronic equipment is a major source of electromagnetic (EMI) and radio frequency (RFI) interference. Such interference has become a problem due at least in part to the movement away from metal and towards plastic as the material from which connector housings are formed. Plastics generally lack the shielding effectiveness inherent in metal housings.

In order to prevent or at least substantially control the emission of interference-causing electromagnetic and radio frequency radiation from multi-conductor cordage used in digital-based electronic equipment and to provide at least some protection from interference-causing signals radiated from external equipment, such cordage has conventionally been provided with "shielding" in the form of a continuous sheath of conductive material between the outer insulation jacket of the cord and the insulated conductors, the shield surrounding and enclosing the conductors along their length. The shield can be formed of any suitable conductive material such, for example, as thin Mylar having a surface coated with aluminum foil, braided metallic material, and the like. The shield acts to suppress or contain the interference-causing electromagnetic and radio frequency signals radiating outwardly from the cordage conductors and, conversely, to prevent such high frequency signals generated by external equipment from causing interference in the conductors.

So-called modular plug connectors are finding increased use in terminating multi-conductor cordage, shielded in the manner described above, through which digital information is transmitted. For example, modular plug connectors are finding increased use in terminating multi-conductor cordage used in home and office computers for connecting the computers with peripheral components, in data communication applications generally, in electronic games, in telephone communication networks and in similar digital applications.

Various configurations of such modular plug connectors are disclosed in patents assigned to Western Electric Company, Inc., such for example as U.S. Pat. Nos. 3,699,498; 3,761,869; 3,860,316; and 3,954,320. Another advantageous configuration of a modular plug connector is disclosed in U.S. Pat. No. 4,211,462 assigned to Stewart Stamping Corporation, assignee of the instant application. The disclosures of the above-mentioned patents are incorporated by reference herein.

Jacks for modular plug connectors are also known. For example, reference is made to the following patents assigned to Bell Telephone Laboratories, Incorporated: U.S. Pat. Nos. 3,990,764; 3,850,497; and 4,224,485.

It has been conventional to ground the conductive EMI/RFI shield of a multi-conductor cord terminated by a modular plug connector by means of a so-called "drain wire" which extends through the cord in electrical engagement with the conductive shield. The drain wire is grounded by passing its end out of the connector and connecting it to a grounded terminal to thereby "drain" the radio frequency and electromagnetic radiation signals conducted through the shield and at the same time ground any electrostatic charge that the shield may have acquired.

However, this technique has not satisfactorily eliminated the problem of interference caused by such radiation. Specifically, it has been found that there is still a tendency for EMI and RFI to result from the leakage of electromagnetic and radio frequency radiation signals from the cordage in the region at which the modular plug connector is inserted into the jack socket. Moreover, it is not uncommon for high frequency signals radiated from nearby equipment to pass through the jack and cause interference in the cord conductors.

For this reason, it has been proposed to modify the modular plug connector by incorporating a shield terminating contact pin as part of the connector itself. Thus, it has been proposed in application Ser. No. 512,375 filed July 11, 1983 and an application entitled Improved Modular Connector For Terminating EMI/RFI Shielded Cordage And Cord Terminated Thereby filed simultaneously herewith, both applications assigned to the assignee of the instant application, to provide a pin-shaped contact formed of electrically conductive material through a passage formed in a side wall of the modular plug connector so that one end of the contact is exposed externally at the side of the connector while a portion of the length of the contact electrically engages a region of the foil shield surrounding the conductors of the cord whose end is terminated by the connector. It is further proposed in said applications that a conventional jack be provided with a grounded contact which engages the exposed end of the pin contact of the modular plug connector upon its insertion into the jack receptacle to ground any electrostatic charge in the shield and conduct the electromagnetic and radio frequency signals carried in the shield to ground thereby preventing leakage of radiation from the connector. The particular construction of the modular plug connector forms no part of the present invention.

It will be understood that it is desirable to provide a jack for a modular plug connector of the type described above, namely, wherein a shield terminating contact pin is incorporated as a part of the modular plug connector itself, which will reliably conduct interference-causing electromagnetic and radio frequency signals from the shield terminating contact pin of the connector to ground and which at the same time will additionally provide an effective EMI/RFI shield for the connector itself to suitably attenuate any radiation which may either leak from the region of the connector or be generated by external equipment.

SUMMARY OF THE INVENTION

Accordingly, one object of the present invention is to provide a new and improved jack for a modular plug connector of the type wherein a shield terminating contact pin is incorporated as a part of the modular plug connector itself which will reliably ground the shield to prevent high frequency emissions and possible electrical arcing due to electrostatic charges.

Another object of the present invention is to provide a new and improved jack of the type described above which also provides an effective EMI/RFI shield for the connector itself to attenuate any radiation passing into or out from the jack.

Still another object of the present invention is to provide a new and improved jack of the type described above which is simple in construction, economic in manufacture and reliable in operation.

Briefly, in accordance with the present invention these and other objects are attained by providing a jack specifically adapted for use with a modular plug connector of the type wherein a shield terminating contact is incorporated as a part of the modular plug connector itself, such as described in application Ser. No. 512,375 filed July 11, 1983 and application Ser. No. 570,805, filed simultaneously herewith, entitled Improved Modular Connector For Terminating EMI/RFI Shielded Cordage And Cord Terminated Thereby. The jack includes separate front and back parts connected to each other to define a rearwardly opening receptacle for a conventional insert presenting a linear array of contacts and a forwardly opening receptacle communicating with the insert receptacle for the modular plug connector. A grounded contact is situated in the modular connector receptacle and affixed therein by respective opposed surfaces of the front and back jack parts. Upon insertion of the plug connector, the externally exposed end of the shield terminating contact engages the grounded jack contact whereupon the radio frequency and electromagnetic radiation signals are carried from the cord shield through the shield terminating contact and through the grounded jack contact to ground.

The two piece construction of the jack functions not only as a means for holding the grounded jack contact securely in place but, additionally, allows the front jack part alone to be formed of a plastic material having good EMI/RFI shielding properties to assure that any radiation generated within or externally of the jack will be sufficiently attenuated to be well within acceptable limits.

DETAILED DESCRIPTION OF THE DRAWINGS

A more complete appreciation of the present invention and many of the attendant advantages thereof will be readily understood by reference to the following detailed description when considered in connection with the accompanying drawings in which:

FIG. 2 is a rear elevation view of the jack illustrated in FIG. 1 with the conventional multi-contact insert component being removed for purposes of clarity;

FIG. 3 is a section view taken along line 3—3 of FIG. 2 illustrating the multi-contact insert in place and further schematically illustrating a modular plug connector being inserted into the connector receiving receptacle of the jack;

Figure 1:
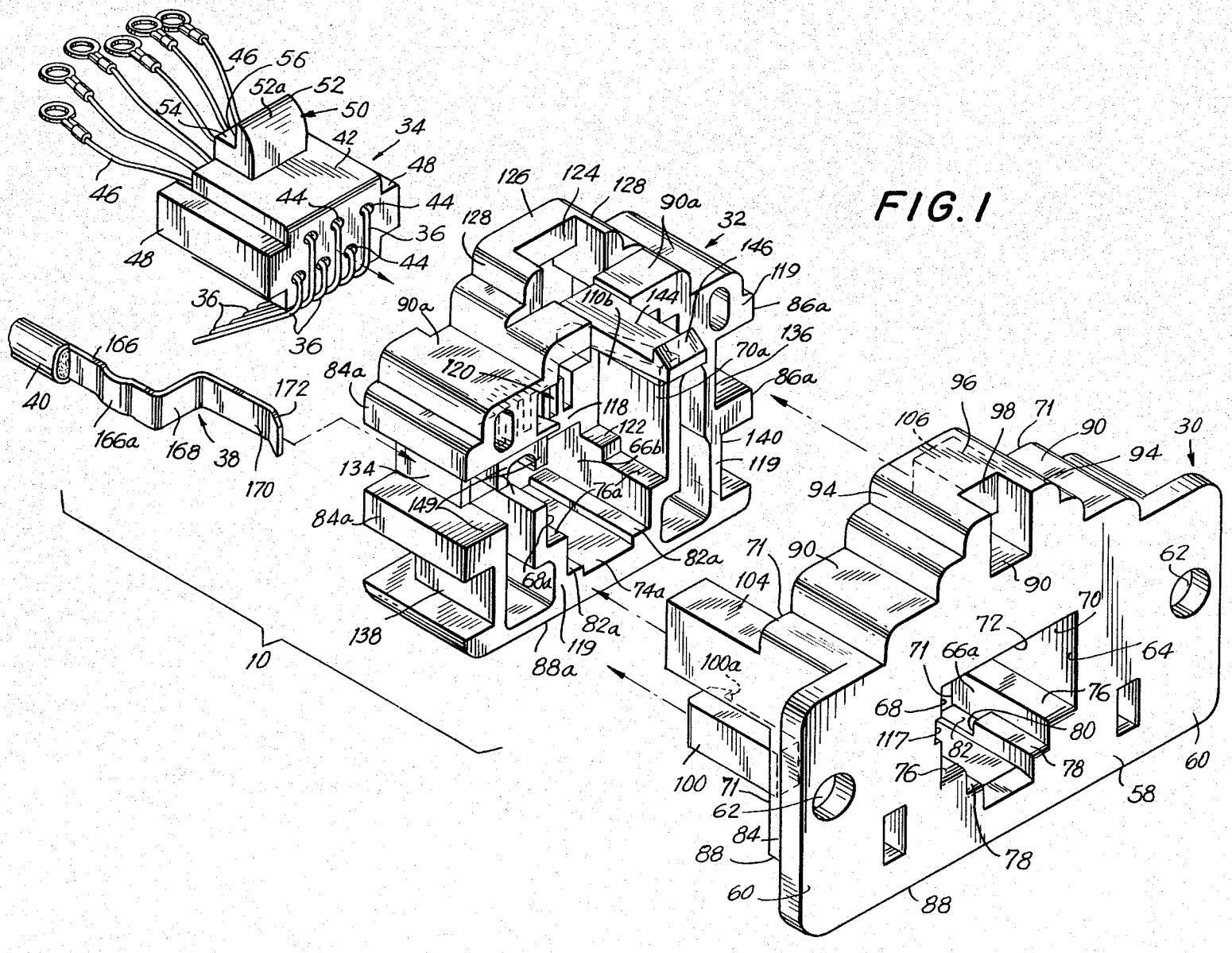
FIG. 1 is an exploded perspective view illustrating the components of a jack in accordance with the present invention and the manner of their assembly.

FIG. 4 is a section view taken along line 4—4 of FIG. 2 and illustrating in phantom the shield terminating contact of the modular plug connector as the latter is inserted into the jack receptacle; and FIG. 5 is a schematic illustration constituting a section view taken along line 5—5 of FIG. 3 and showing the manner in which a shield terminating pin-type contact incorporated as part of the modular plug connector engages the cord shield.

DESCRIPTION OF THE PREFERRED EMBODIMENTS

Referring now to the drawings wherein like reference characters designate identical or corresponding parts throughout the several views, a jack in accordance with the present invention, generally designated 10 is illustrated. The jack 10 is adapted for use with a modular plug connector 12 (FIGS. 3 and 5) of the type which terminates a multi-conductor cord having a foil EMI/RFI shield surrounding the conductors over their length and wherein a shield terminating contact pin 14 is incorporated as a part of the modular plug connector itself, such as disclosed in application Ser. No. 512,375 filed July 11, 1983 and the application filed simultaneously herewith entitled Improved Modular Connector For Terminating EMI/RFI Shielded Cordage, both assigned to the assignee of the instant application.

Briefly, the shielded cord 16 comprises a plurality (four shown in the illustrated embodiment) of insulated conductors 18 within an insulating outer jacket 20. In order to prevent or suppress the radiation of electromagnetic and radio frequency signals from the cord, such as when the conductors transmit high frequency digital information, which may cause interference in surrounding electronic equipment (and to suppress externally caused EMI and RFI in the conductors), a shield 22 formed of a sheath of thin conductive material, such as aluminum foil, encloses the insulated conductors 18 along their length between the conductors and the outer jacket 20. Such shielding is of course conventional.

Except for the provision of the shield terminating contact pin 14, the construction of the modular plug connector is substantially conventional and reference is made to the previously mentioned patents of Western Electric Co., Inc. and the above-mentioned U.S. Pat. No. 4,211,462 of Stewart Stamping Corporation which describe the construction of modular plug connectors in greater detail. The modular plug connector includes a housing 24 formed of a dielectric material which defines an internal cord receiving cavity 26 into which the end of the multi-conductor shielded cord 16 to be terminated is inserted through a cord-receiving aperture formed at one of the housing ends.

Prior to insertion of the cord end, the end portion of the outer jacket 20 is removed to expose the foil shield 22. The portion of the exposed foil shield 22 overlying the conductors 18 is folded back over the outer jacket 20 as shown at **22*a* in FIGS. 3 and 4 while the corresponding portion of the foil shield 22 underlying the conductors may be removed to fully expose the end regions of conductors 18**.

The cord-receiving cavity 26 includes a jacket-receiving portion **26*a* (FIG. 3) adjacent the aperture and a communicating conductor-receiving portion 26*b* into which the now exposed individual insulated conductors 18 are received. A plurality of flat contact terminals 28, corresponding in number to the number of conductors of the cord, are inserted into individual slots (not shown) provided in the housing, each terminal being aligned with and electrically engaging a respective conductor 18. The conductors 18 are generally of tinsel, stranded or solid construction while the terminals 28 have blade-like portions which pierce and engage respective conductors 18 in a solderless connection. The flat contact terminals have upper edges 28***a* which are exposed at the top of the housing for engagement with respective aligned contact elements provided in the jack as described in greater detail below. The cord end is secured to the connector by conventional jacket anchoring and strain relief portions (not shown) integrally hinged to the housing and movable against the cord so as to prevent separation of the connector from the cord during use as well as to provide strain-relief facilities for the conductors and jacket.

The modular plug connector has a shield terminating contact pin 14 incorporated therein. In the illustrated embodiment the contact pin 14 comprises an elongate rod-like member formed of electrically conductive material, such as phosphor bronze. The contact pin 14 extends through an opening formed in a side wall 12*a* of the connector 12 so that a dome-shaped head portion 14*a* of the contact pin 14 is exposed externally and protrudes beyond the outer surface of the connector side wall 12*a* as best seen in FIG. 5. At the same time, a portion 14*b* of the length or shank of the contact pin 14 electrically engages the folded-back exposed portion 22*a* of foil shield 22.

Referring now to FIGS. 1–4 and more particularly to FIG. 1, the jack 10 is formed of an assembly of components including a front part 30 and a back part 32 designed to mate with and connect to the front part 30 to form a jack housing having a forwardly opening receptacle for the modular plug connector 12 and a rearwardly opening receptacle for receiving a conventional multi-contact insert 34, the latter presenting a linear array of wire contacts 36 each of at least a portion of which electrically engages a corresponding flat contact terminal 28 of the modular plug connector 12 along its upper edge 28*a* as described below. A leaf-spring type jack contact 38 is affixed within the jack housing as described below so as to be positioned to be electrically engaged by the dome-shaped head 14*a* of the shield terminating contact 14 of the modular plug connector 12 as the latter is inserted into the connector receptacle. The jack contact 38 is connected to ground through a conductor 40.

The front and back parts 30 and 32 are molded by conventional techniques of suitable plastic material such, for example, as ABS. In the illustrated embodiment, the front part 30 is formed of a plastic material specifically adapted to provide EMI/RFI shielding in order to attentuate any electromagnetic and radio frequency radiation passing out from or into the jack connector receptacle. For example, the front part 30 may be formed of ABS with an aluminum flake or polycarbonate filling or an alloy resin marketed by Mobay Chemical Corp. of Pittsburg, Pa. under the trademark Bayblend.

The multi-contact insert 34 is a conventional component of the type sold by Berg Electronics of New Cumberland, Pa. and illustrated in its Bulletin designated 1800 of June, 1981. The insert 34 includes a body 42 in the shape of a right rectangular prism and formed, for example, of ABS. A plurality of bores 44 are formed through the insert body 42, each bore opening at both the front and rear surfaces of the body 42. In construction, one end of a contact wire 36 is connected to the end of a respective conductor 46 and the free end of the contact wire 36 is inserted through a respective bore 44 from the rear surface of the insert body 42 until it extends from the forward opening of the bore. The wire 36 is then bent downwardly over the front surface of the insert body, preferably being received in respective grooves formed therein and, finally, the free end or contact region of the wire 36 is bent to extend downwardly and towards the rear of the insert body. In this manner, a linear array of equidistant flexible wire contacts 36 are obtained. A pair of longitudinal ribs 48 extend from each side surface of the insert body 42. A latch portion 50 extends from the rearward central region of the upper surface of the insert body 42. The latch portion 50 includes an upstanding detent 52 having a forward sloped camming surface 52*a* and a reduced height step which forms upwardly and rearwardly facing shoulders 54 and 56.

The front and back parts 30 and 32 each have substantially symmetrical configuration except for certain construction provided for accommodating and fixing the grounded jack contact 38 in place. As described below, when connected, the front and back parts 30 and 32 form a jack housing in which receptacles for the modular plug connector and the multi-contact insert 34 are formed as well as means for accommodating and fixing the grounded jack contact 38 in a position such that the head of the shield terminating contact pin of an inserted connector will electrically engage it to ground the foil shield.

The front part 30 has a front wall 58 having a planar forward surface from which a pair of lateral mounting flanges 60 extend through which mounting holes 62 are formed. An opening 64 is formed in the front wall 58 constituting an entrance to the front portion 66*a* of the receptacle 66 for the modular plug connector, i.e., the portion of the connector receptacle defined within the front part 30. The connector receptacle portion 66*a* is defined by first and second inwardly facing side walls extending through the full length of the front part 30, i.e., between entrance opening 64 and the rear edge surface 71 of the front part 30, a downwardly facing top wall 72, an upwardly facing bottom wall 74, a pair of upwardly directed support shoulders 76 extending adjacent to the side walls 68, 70 rearwardly from the front surface 58 to the rear edge surface 71, and a pair of shoulders 78 spaced inwardly adjacent shoulders 76 and extending rearwardly from the front surface 58, each shoulder 78 being stepped in a plane recessed inwardly from the rear edge surface 71 to define a rearwardly facing detent shoulder 80 and a rearwardly extending shelf 82 whose upper surface is only slightly higher than the plane of the bottom wall 74.

The outer configuration of the front part 30 is defined by a pair of outer side walls 84 and 86, a bottom wall 88 and a top wall 90. A centrally disposed open ended passage 92 (FIG. 3) is formed over top wall 90. The passage is enclosed by the upper surfaces of the top wall 90, a pair of side walls 94 and upper wall 96 which extends forwardly from the rear edge surface 71 of the front part 30 terminating in a plane recessed inwardly from the forward surface of front wall 58 to define a forwardly facing detent shoulder 98.

A pair of elongate latching members 100 and 102 extend in a rearward direction from the rear edge surface 71 of the lower regions of the outer side walls 84 and 86 respectively, the latching members terminating at their free ends in inwardly directed barbs 100*a* and 102*a*. Similarly, a pair of elongate guide members 104 and 106 extend rearwardly from the rear edge surface 71 of the outer side walls 84 and 86 respectively, the guide members being spaced above and substantially parallel to the corresponding latching members 100 and 102.

Referring to FIG. 3, the first and second inwardly facing side walls 68 and 70 of the front portion 66*a* of the modular plug connector receptacle 66 extend upwardly beyond the top wall 72 of connector receptacle 66 in the form of a pair of respective upper side walls 108 (only one shown) which in turn constitute the side walls of the front portion 110*a* of a receptacle 110 for the multi-contact insert 34. As described below, the insert 34 is introduced into the completed jack through an opening in the back wall of the back part 32. A forwardly tapering channel 112 is formed in each upper side wall 108 extending from the rear edge surface 71 of the front part 30 to the rear surface of front wall 58. The channels 112 form inner portions of longer gradually tapering channels formed by the assembly of the front and back parts 30 and 32. The junction of each upper side wall 108 and a respective one of the first and second side walls 68, 70 forms a downwardly facing shoulder 114 which is coplanar with the top wall 72 of connector receptacle 66.

In order to accommodate and fix the grounded jack contact 38 in place, a channel 116 (FIG. 4) is formed in the first connector receptacle side wall 68 extending rearwardly from the rearward surface of the front wall 58 and opening at the rear edge surface 71 of the front part 30. The channel 116 forms an outer portion of a larger contact housing channel formed by the assembly of the front and back parts 30 and 32. A notch 117 is formed in the first side wall 68 extending through the front wall 58 to the opening 64 of the connector receptacle 66 providing a key-type passage for the head 14*a* of the shield terminating contact pin 14 during insertion of the modular plug connector 12 as described below.

The back part 32 of the jack is connected to the front part 30 with its forward edge surface 119 abutting against the rearward edge surface 71 of the front part to form the jack housing in which the modular plug connector and multi-contact insert receptacles are defined. It will be understood that various surfaces, shoulders, channels, etc. of the back part 32 which define the back portions 66*b* and 110*b* of the modular plug connector and multi-contact insert receptacles 66 and 110 will form substantial continuations or extensions of corresponding structure of the front part 30. Accordingly, for the sake of simplicity reference to the various surfaces, shoulders, channels, etc. which form such extensions or continuations will be designated by the same reference numerals which designate the corresponding structure in the front part 30, followed by the suffix "a".

Referring to the figures, the rear portion 66*b* of the receptacle 66 for the modular plug connector is defined by first and second inwardly facing side walls 68*a* and 70*a* extending from the forward edge surface 116 to a forwardly facing surface 118 defined by a comb portion 120 described below, an upwardly facing bottom wall 74*a*, a pair of upwardly directed support shoulders 76*a* extending rearwardly from the front edge surface 116 to a pair of vertical steps 122 and a pair of rearwardly extending shelves 82*a*.

The outer configuration of the back part 32 is defined by a pair of outer side walls 84*a* and 86*a*, a bottom wall 88*a* and top wall 90*a*. A forwardly facing centrally positioned detent surface 124 is presented by an elongate bridging portion 126 which extends between a pair of side walls 128 projecting upwardly from the top wall 90*a*.

The first and second inwardly facing side walls 68*a* and 70*a* which define the back portion 66*b* of the modular plug connector receptacle 66 extend upwardly beyond receptacle portion 66*b* to form respective upper side walls 108*a* of the back portion 110b of the receptacle 110 for the multi-contact insert 34. The side walls 108*a* open onto the rearward surface of the rear wall 130 of the back part 32 to define an entrance opening 132 (FIG. 2) through which the multi-contact insert 34 is introduced into the insert receiving receptacle 110. A forwardly tapering channel 112*a* is formed in each upper side wall 108*a* which merge with the corresponding channels 112 as noted above to define an opposed pair of forwardly tapering channels 112*a*, 112; 112*a*, 112 extending in a forward direction from the insert entrance opening 132 to the rear surface of the front wall 58 of front part 30. The junction of each upper side wall 108*a* and a respective one of the first and second side walls 68*a*, 70*a* forms a downwardly facing shoulder 144*a*.

A pair of relatively wide channels 134 and 136 are formed in the outer side walls 84*a* and 86*a* respectively adapted to snugly receive the guide members 104 and 106 to thereby guide the respective parts accurately towards each other during assembly of the jack. Similarly, a pair of narrower latching channels 138 and 140 which terminate at detent shoulders 142 are formed in the outer side walls 84*a* and 86*a* below guide channels 134 and 136 and are adapted to receive the latching members 100 and 102 during assembly of the jack, the latching members flexing outwardly during connection of the front and back parts until the barbs 100*a* and 102*a* snap into engagement with the detent shoulders 142. Moreover, an elongate latching member 144 extends forwardly from the central region of the top wall 90*a* terminating at its forward end at an upwardly extending barb 146. During assembly of the jack, the latching member 144 aligns with and is inserted through the passage 92 in the front part 30 until the barb 146 engages the detent shoulder 98.

In order to ensure precise positioning of the individual wire contacts 36 when the insert 34 is introduced into receptacle 110, a comb portion 120 is formed in the rear wall 130 of back part 32 just below insert entrance opening 132. The comb portion includes a laterally extending bar 148 having a top surface 150 which slopes upwardly in the forward direction as best seen in FIG. 3. A plurality of mutually equally spaced teeth 152 extend upwardly from the bar 148 to define a number of adjacent spaces or grooves between them corresponding in number and spacing to the wire contacts 36 of the insert 34.

Finally, a through slot 149 (FIG. 4) is formed in the first side wall 68*a* opening onto the side wall 68*a* and into the guide channel 134. The through slot 149 cooperates with the channel 116 in the accommodation and affixation of the grounded jack contact 38. A notch 154 is formed in the guide member 104 to provide a space between the guide member 104 and the inner wall of the guide channel 134 upon assembly of the front and back parts in which a portion of the jack contact 38 is accommodated. The notch 154 and slot 149 together define forwardly facing surface 158 which confronts and is slightly spaced from a rearwardly facing surface 156 provided by a block portion 159 extending from the rear edge surface 71 of the front part 30 within the notch 154, one surface of which forms a continuation of the channel 116.

In assembly, the front and back parts 30 and 32 are connected to each other with the grounded jack contact 38 pre-positioned so as to present a contact portion in the receptacle 66 for the modular plug connector and in such a manner that when the connector is fully inserted, the head 14*a* of the shield terminating contact pin 14 engages the contact portion of the grounded jack contact 38 at a location disposed substantially centrally within the front portion 66*a* of the receptacle 66. In the illustrated embodiment, the jack contact 38 comprises a leaf-spring type contact having a first straight portion 166 one end of which is connected to the ground conductor 40 and in which an offset protuberance 166*a* is formed, a short right angle portion 168, and a terminal contact portion 170 whose major length extends at an angle somewhat greater than 90° from the right angle portion 168. The free end 172 of contact portion 170 is bent inwardly to provide a camming surface as described below. Prior to connecting the front and back parts 30 and 32, the jack contact 38 is positioned with the straight contact portion 166 contiguous with the inner surface of guide groove 134 of back part 32 and so that the right angle portion 168 extends into and through the slot 149 as best seen in FIG. 4. The front and back parts 30 and 32 are then assembled to each other by introducing the guide members 104 and 106 into the guide grooves 134 and 136 respectively whereupon the front and back parts are urged towards each other. The latching members 100 and 102 are thereby received within respective latching channels 138 and 140 while the latching member 144 is introduced into the passage 92. When the rear edge surface 71 of the front part 30 becomes contiguous with the front edge surface 19 of the back part 32, the barbs 100*a* and 102*a* of the latching members 100 snap into engagement with the detent shoulders 142 while the upwardly extending barb 146 of latching member 144 snaps into engagement with the detent shoulder 98 whereby the front and back parts become locked to each other. The terminal contact portion 170 of the grounded jack contact 38 becomes positioned within the channel defined by the channel 116 in the front part 30 and the slot 149 in the back part 32 and, as seen in FIG. 4, the jack contact 38 is shaped so that the outer contact surface of the contact portion 170 is substantially coplanar with the plane of the side wall 68 at a region substantially centrally disposed in the front portion 66*a* of the connector receiving receptacle 66. The jack contact 38 is firmly held in place by the inner surface of the notch 154 of guide member 104 and the inner surface of the guide channel 134, the protuberance 166*a* being held in compression. The right angle portion 168 extends through the space defined between the rearwardly facing surface 156 of portion 159 and the forwardly facing surface 158 of slot 149.

To complete the jack, the multi-contact insert 34 is inserted into the receptacle 110 through entrance opening 132. The ribs 48 of the insert 34 are received within respective forwardly tapering channels 112*a*, 112 while the individual contact wires 36 are received within respective spaces defined between the teeth 152 of the comb portion 120. As the insert 34 is urged towards the front of the jack housing, the camming surface 52*a* of detent 52 of latch portion 50 engages the bridging portion 126 flexing the insert body towards the contact wires 36 to allow the detent 52 to pass beneath the bridging portion 126 whereupon when the insert is fully introduced the insert body will flex upwardly so that the rearwardly facing shoulder 56 of detent 52 engages the detent surface 124 of the bridging portion 126 as seen in FIG. 3. The free ends of each contact wire 36 are resiliently biased against the upwardly sloped surface 150 of the bar 148 of comb portion 120, i.e., the contact wires 36 are slightly flexed towards the insert body causing the insert body 42 to obtain the orientation within receptacle 110 shown in FIG. 3 and the contact wires being urged against surface 150.

In use, the modular plug connector 12 is inserted into the connector receiving receptacle 66 through entrance opening 64 as shown in FIG. 3. The flat contact terminals 28 are aligned with respective contact wires 36 of the insert 34 whereby upon full insertion of the connector 12, the conductors 18 in cord 20 will electrically communicate with respective conductors 46 through the contact terminals 28 and contact wires 36. During insertion, the edge regions 176 of the bottom wall of the modular plug connector are supported on the support shoulders 76, 76*a* while upward movement of the connector is limited by the downwardly facing shoulders 114, 114*a*. A locking lever 178 is connected to the bottom of the leading end of the connector as seen in FIG. 3 and extends downwardly in the rearward direction. As the connector is inserted into receptacle 66, a forward, wider portion 178*a* thereof contacts the upwardly facing shoulders 78 to flex the lever toward the connector. A pair of transverse locking shoulders 180 are defined at the junction of a rearward, narrower portion 178*b* of lever 178 and the wider forward portion 178*a*, the locking shoulders 180 being positioned such that when the connector is fully inserted in receptacle 66, i.e., the leading end of the connector is contiguous with the surface 118 which constitutes the rear surface of receptacle 66, the lever 178 snaps downwardly so that the locking shoulders 180 engage the detent shoulders 80, the portion 178*b* of lever 178 being narrow enough to move downwardly between the shoulders 78. In this manner the connector is locked in the jack receptacle 66. To unlock the connector it is only necessary to lift the lever 178 to disengage locking shoulders 180 from detent shoulders 80.

The head 14*a* of the shield terminating contact pin 14 passes through the notch 117 during connector insertion as seen in FIG. 4 and engages the camming surface of the free end 172 of the terminal contact portion 170 urging the contact portion 170 outwardly. When the modular plug connector is fully inserted, the head 14*a* of the shield terminating contact pin 14 electrically engages the contact portion 170 of the grounded jack contact 38 at a region disposed substantially centrally of the front portion 66*a* of the receptacle 66. The contact portion 170 is constantly urged against the head 14*a* under the spring forces resulting from its outward flexing from its underformed shape as described above. In this manner, the electromagnetic and radio frequency signals carried in the foil shield 22 are carried to ground through the shield terminating contact pine 14, the jack contact 38 and conductor 40. Any electrostatic charge on the shield will be grounded at the same time.

The jack 10 of the present invention provides several important advantages. The two piece construction of the jack housing provides the dual advantage of both providing means for accommodating and fixing the jack contact 38 in place in a simple yet reliable manner and, additionally, provies the possibility of forming only the front part 30 of a plastic material having good EMI/RFI shielding properties so that any high frequency radiation from within the jack outwardly or from external sources into the jack is controlled well within acceptable limits. In this connection, it is desirable although not essential that the point of contact between the head 14*a* of the shield terminating contact pin 14 and the terminal contact portion 170 of jack contact 38 be substantially centrally disposed within the front part 30. The jack 10 has a relatively simple construction and is easy to assemble.

Obviously, numerous modifications and variations of the present invention are possible in the light of the above teachings. For example, the construction of the shield terminating contact pin 14 and jack contact 38 may be different from that shown. In one case, the head 14*a* of the contact pin 14 may have a substantially cylindrical or disk shape while the contact portion of the jack contact may be configured so as to engage the peripheral or cylindrical surface of the head to provide a line contact rather than a point contact as is the case in the illustrated embodiment. The jack may be adapted for either a "left-hand" connector, i.e., where the shield terminating contact pin has its head situated on the left side of the connector housing as is the case in the illustrated embodiment, or for a "right-hand" connector. It should also be noted that the dimension between the inwardly facing vertical surfaces of the support shoulder 76 is preferably selected so as to be smaller than the corresponding dimension of a conventional telephone modular connector to reliably prevent inadvertent insertion of such a connector into the jack.

It will therefore be understood that the invention may thus vary from the particular embodiment disclosed herein within the scope of the claims appended hereto.

What is claimed is:

1. A jack for a modular plug connector which terminates a cord constituted by a plurality of insulated conductors surrounded by a sheath of conductive material constituting a shield for suppressing radiation of electromagnetic and radio frequency interference-causing signals from and to the conductors, the modular plug connector including a dielectric housing having a cord-receiving aperture communicating with an internal cord-receiving cavity having a conductor-receiving portion in which the cord conductors are situated, a plurality of flat contact terminals having conductive piercing portions and contact edges, each flat contract terminal being situated in a respective slot in the housing aligned with a respective conductor with its piercing portion piercing said respective conductors to electrically engage the same and wherein the contact edges of the flat contact terminals are exposed at a common side wall of the housing, and shield terminating contact means passing through a side wall of said connector housing electrically engaging said shield, the shield terminating contact means including an externally exposed portion situated at the exterior surface of one of the walls of the connector housing, the jack comprising:

a jack housing having a receptacle for the modular plug connector, an array of contact wires mounted in said jack housing having portions situated within said connector receptacle adapted to be electrically engaged by contact edges of respective flat contact terminals upon insertion of the modular plug connector into said connector receptacle, grounded jack contact means adapted to be electrically engaged by said externally exposed portion of said shield terminating contact means upon insertion of the modular plug connector into said connector receptacle and wherein at least a portion of said jack housing is formed of a material which attenuates electromagnetic and radio frequency interference-causing signals passing therethrough so that the jack housing constitutes an EMI/RFI shield for the modular plug connector.

2. The combination of claim 1 wherein said contact wires constitute a part of a multi-contact insert, said jack housing having a receptacle for said multi-contact insert in which said insert is situated.

3. The combination of claim 2 wherein said housing includes a comb portion defining a plurality of adjacent slots, each slot receiving a respective one of said contact wires to precisely position the same in a position aligned with a respective one of the flat contact terminals.

4. The combination of claim 2 wherein said jack housing has front and rear walls, said connector receptacle having an entrance opening in said front wall and said insert receptacle having an entrance opening in said rear wall.

5. The combination of claim 1 wherein said signal attenuating material is a plastic material.

6. The combination of claim 5 wherein said plastic material comprises a plastic material filled with discrete pieces of conductive material.

7. The combination of claim 6 wherein said plastic material comprises ABS filled with aluminum flakes.

8. The combination of claim 1 wherein said jack housing is formed of separate front and back parts connected to each other by means for interconnecting the same.

9. The combination of claim 8 wherein said means for interconnecting said front and back parts include at least one elongate latching member extending from one of said front and back parts and at least one corresponding detent means provided on the other of said front and back parts adapted to be latchingly engaged by said latching member to interconnect said front and back parts to form said jack housing.

10. The combination of claim 9 wherein said interconnecting means further includes at least one elongate guide member extending from one of said front and back parts and at least one corresponding guide channel formed in the other of said front and back parts adapted to receive said corresponding elongate guide member to facilitate interconnection of said front and back parts.

11. The combination of claim 8 wherein said front and back parts define front and back portions of said connector-receiving receptacle respectively.

12. The combination of claim 11 wherein said contact wires constitute a part of a multi-contact insert, said jack housing having a receptacle for said multi-contact insert in which said insert is situated.

13. The combination of claim 11 wherein upon insertion of said connector into said receptacle, the externally exposed portion of said shield terminating contact means engages said grounded jack contact means at a substantial mid-portion of said connector receptacle front portion.

14. The combination of claim 13 wherein said front and back parts define front and back portions of said insert-receiving receptacle respectively.

15. The combination of claim 14 wherein an entrance opening to said connector receptacle is formed in a forward wall of said front part and wherein an entrance opening to said insert receptacle is formed in a rear wall of said back part.

16. The combination of claim 15 wherein a comb portion is provided at said rear wall of said back part, said comb portion defining a plurality of adjacent slots, each slot receiving a respective one of said contact wires to precisely position the same in a position aligned with a respective one of the flat contact terminals.

17. a jack for a modular plug connector which terminates a cord constituted by a plurality of insulated conductors surrounded by a sheath of conductive material constituting a shield for suppressing radiation of electromagnetic and radio frequency interference-causing signals from and to the conductors, the modular plug connector including a dielectric housing having a cord-receiving aperture communicating with an internal cord-receiving cavity having a conductor-receiving portion in which the cord conductors are situated, a plurality of flat contact terminals having conductive piercing portions and contact edges, each flat contact terminal being situated in a respective slot in the housing aligned with a respective conductor with its piercing portion piercing said respective conductors to electrically engage the same and wherein the contact edges of the flat contact terminals are exposed at a common side wall of the housing, and shield terminating contact means passing through a side wall of said connector housing electrically engaging said shield, the shield terminating contact means including an externally exposed portion situated at the exterior surface of one of the walls of the connector housing, the jack comprising:

a jack housing having a receptacle for the modular plug connector, an array of contact wires mounted in said jack housing having portions situated within said connector receptacle adapted to be electrically engaged by contact edges of respective flat contact terminals upon insertion of the modular plug connector into said connector receptacle, a grounded jack contact mounted in said jack housing having a terminal portion situated within said connector receptacle adapted to be electrically engaged by said externally exposed portion of said shield terminating contact means upon insertion of the modular plug connector into said connector receptacle, and wherein said connector receptacle is at least partially defined by a pair of opposed side walls, said grounded jack contact being mounted at one of said connector receptacle side walls, and wherein said array of contact wires are situated in a plane which is substantially orthogonal to the plane of said connector receptacle side wall at which said jack contact is mounted.

18. A jack for a modular plug connector which terminates a cord constituted by a plurality of insulated conductors surrounded by a sheath of conductive material constituting a shield for suppressing radiation of electromagnetic and radio frequency interference-causing signals from and to the conductors, the modular plug connector including a dielectric housing having a cord-receiving aperture communicating with an internal cord-receiving cavity having a conductor-receiving portion in which the cord conductors are situated, a plurality of flat contact terminals having conductive piercing portions and contact edges, each flat contact terminal being situated in a respective slot in the housing aligned with a respective conductor with its piercing portion piercing said respective conductors to electrically engage the same and wherein the contact edges of the flat contact terminals are exposed at a common side wall of the housing, and shield terminating contact means passing through a side wall of said connector housing electrically engaging said shield, the shield terminating contact means including an externally exposed portion situated at the exterior surface of one of the walls of the connector housing, the jack comprising:

a jack housing having a receptacle for the modular plug connector, an array of contact wires mounted in said jack housing having portions situated within said connector receptacle adapted to be electrically engaged by contact edges of respective flat contact terminals upon insertion of the modular plug connector into said connector receptacle, a grounded jack contact mounted in said jack housing having a terminal portion situated within said connector receptacle adapted to be electrically engaged by said externally exposed portion of said shield terminating contact means upon insertion of the modular plug connector into said connector receptacle, said jack housing being formed of separate from and back parts connected to each other by means for interconnecting the same, said front and back parts including mutually confronting surfaces at least partially constituting means for accommodating and fixing said grounded jack contact within said housing with said terminal portion thereof situated within said connector receptacle.

19. The combination of claim 18 wherein said connector receptacle includes a pair of opposed side walls and wherein said interconnecting means further includes at least one elongate guide member extending from one of said front and back parts and at least one corresponding guide channel formed in the other of said front and back parts adapted to receive said corresponding elongate guide member to facilitate interconnection of said front and back parts, and wherein said means for accommodating and fixing said grounded jack contact within said housing further includes elongate channel means formed in a first one of said connector receptacle side walls, a notch formed in said guide member defining a space between an inner surface of said guide member and an outer surface of said other of said front and back parts, and a slot formed in said first one of said connector receptacle side walls forming a right-angle space between said channel means.

20. A jack for a modular plug connector which terminates a cord constituted by a plurality of insulated conductors surrounded by a sheath of conductive material constituting a shield for suppressing radiation of electromagnetic and radio frequency interference-causing signals from and to the conductors, the modular plug connector including a dielectric housing having a cord-receiving aperture communicating with an internal cord-receiving cavity having a conductor-receiving portion in which the cord conductors are situated, a plurality of flat contact terminals having conductive piercing portions and contact edges, each flat contact terminal being situated in a respective slot in the housing aligned with a respective conductor with its piercing portion piercing said respective conductors to electrically engage the same and wherein the contact edges of the flat contact terminals are exposed at a common side wall of the housing, and shield terminating contact means passing through a side wall of said connector housing electrically engaging said shield, the shield terminating contact means including an externally exposed portion situated at the exterior surface of one of the walls of the connector housing, the jack comprising:

a jack housing having a receptacle for the modular plug connector, an array of contact wires mounted in said jack housing having portions situated within said connector receptacle adapted to be electrically engaged by contact edges of respective flat contact terminals upon insertion of the modular plug connector into said connector receptacle, a grounded jack contact mounted in said jack housing having a terminal portion situated within said connector receptacle adapted to be electrically engaged by said externally exposed portion of said shield terminating contact means upon insertion of the modular plug connector into said connector receptacle, said jack housing being formed of separate front and back parts connected to each other by means for interconnecting the same, and wherein said connector receptacle is at least partially defined by a pair of opposed side walls, said grounded jack contact being mounted at one of said connector receptacle side walls, and wherein said array of contact wires are situated in a plane which is substantially orthogonal to the plane of said connector receptacle side wall at which said jack contact is mounted.

21. A jack for a modular plug connector which terminates a cord constituted by a plurality of insulated conductors surrounded by a sheath of conductive material constituting a shield for suppressing radiation of electromagnetic and radio frequency interference-causing signals from and to the conductors, the modular plug connector including a dielectric housing having a cord-receiving aperture communicating with an internal cord-receiving cavity having a conductor-receiving portion in which the cord conductors are situated, a plurality of flat contact terminals having conductive piercing portions and contact edges, each flat contact terminal being situated in a respective slot in the housing aligned with a respective conductor with its piercing portion piercing said respective conductors to electrically engage the same and wherein the contact edges of the flat contact terminals are exposed at a common side wall of the housing, and shield terminating contact means passing through a side wall of said connector housing electrically engaging said shield, the shield terminating contact means including an externally exposed portion situated at the exterior surface of one of the walls of the connector housing, the jack comprising:

a jack housing having a receptacle for the modular plug connector, an array of contact wires mounted in said jack housing having portions situated within said connector receptacle adapted to be electrically engaged by contact edges of respective flat contact terminals upon insertion of the modular plug connector into said connector receptacle, a grounded jack contact mounted in said jack housing having a terminal portion situated within said connector receptacle adapted to be electrically engaged by said externally exposed portion of said shield terminating contact means upon insertion of the modular plug connector into said connector receptacle, said jack housing being formed of separate front and back parts connected to each other by means for interconnecting the same, and wherein at least said front part of said housing is formed of a material which attenuates electromagnetic and radio frequency interference-causing radiation passing therethrough so that the jack housing constitutes an electromagnetic and radio frequency radiation shield for the modular plug connector.

* * * * *